US005419003A

United States Patent [19]

Tollasepp

[11] Patent Number: 5,419,003

[45] Date of Patent: May 30, 1995

[54] PAINT ROLLER WITH FREE END FEEDING

[76] Inventor: Tonis Tollasepp, 120 Applefield Drive, Scarborough, Ontario, Canada, M1P 3Y2

[21] Appl. No.: 295,101

[22] Filed: Aug. 24, 1994

Related U.S. Application Data

[63] Continuation-in-part of Ser. No. 157,460, Nov. 26, 1993.

[51] Int. Cl.[6] ..... B05C 1/10

[52] U.S. Cl. ..... 15/230.11; 15/248.2; 401/197

[58] Field of Search ..... 15/230.11, 104.93, 104.94, 15/248.2, 257.06; 220/229, DIG. 19; 401/23, 197, 208

[56] References Cited

U.S. PATENT DOCUMENTS

| | | | |
|---|---|---|---|
| 2,325,867 | 8/1943 | Matsakas | 15/230.11 |
| 2,584,724 | 2/1952 | Mattie | 15/230.11 |
| 2,605,487 | 8/1952 | Bugg | 15/230.11 |
| 2,708,763 | 5/1955 | Jacoby | 15/230.11 |
| 2,751,618 | 6/1956 | Pruitt | 15/230.11 |
| 3,588,264 | 6/1971 | Mallindine | 15/230.11 |
| 3,609,051 | 9/1971 | Braun | 401/197 |
| 4,282,891 | 8/1981 | Duceppe | 15/104.94 |
| 4,735,522 | 4/1988 | Myun-Sik | 15/230.11 |

*Primary Examiner*—David A. Scherbel
*Assistant Examiner*—James F. Hook

[57] ABSTRACT

A paint roller has a rotatably mounted resilient foam roller on an apertured sleeve. The sleeve is mounted on the free end of a shaft. The foam roller projects beyond the free end of the shaft and contains a normally, slit passage leading to the sleeve. The slit passage allows the insertion of a paint feed nozzle but closes when the nozzle is withdrawn to serve the function of a valve. Also the arrangement allows feeding the paint from the free end, rather than the handle end, of the roller.

6 Claims, 3 Drawing Sheets

PAINT ROLLER WITH FREE END FEEDING

This application is a Continuation-in-Part of my application Ser. No. 08/157,460 filed Nov. 26, 1993.

This application relates to a paint roller of resilient open celled foam and to a supply probe for use therewith.

The invention described herein is the subject of Disclosure Document 357733 filed Jul. 11, 1994.

The earlier application describes a very useful paint roller having an apertured axle with an end mounted on the handle, and with an apertured sleeve slidably rotatably contacting the axle to rotate thereon, and a resilient open foam roller mounted on said sleeve. Paint was supplied to such roller by supply under pressure to the axle through a one-way valve at the handle end. This earlier roller design had two disadvantages. Firstly, there is some inconvenience to providing paint to the handle end of the axle. Secondly, the one way valve was an added expense.

In this application there is described a paint roller including a handle and a roller assembly, the assembly extending from a handle end to a free end. The roller assembly comprises a tubular axle attached to said handle and extending therefrom to a free end with the axle being open at its free end and apertured to allow the travel of paint through its side walls. A sleeve is designed to slidably rotate on said roller and is apertured to allow the passage of paint outwardly therethrough, a resilient open celled foam cylinder having an axial inward extent and an axial outward extent. The inner extent includes an axial bore dimensioned to receive and resiliently attach said cylinder to said sleeve and the outer extent is provided with a normally closed axial slit.

The roller thus designed may be supplied with paint by a hollow probe connected to receive a supply of paint under pressure with the probe being designed to enter and distend the slit and enter the open free end of the axle to deliver paint thereto.

Thus in the new paint roller design, the roller may, more conveniently, supplied with paint through its free end. Moreover, the slit, in the resilient open celled foam of the foam cylinder acts as a valve so that a one-way valve may be depressed with.

It is desireable that the outer extent of the foam roller, which is unsupported, be not too long to avoid any tendency of such outer extent to unduly deform under roller pressure during painting. Thus, the outer extent should be less than one half the axial length of the foam roller and preferably should be less than one quarter the axial length.

In the drawings which illustrate a preferred embodiment of the invention:

Figure 1:
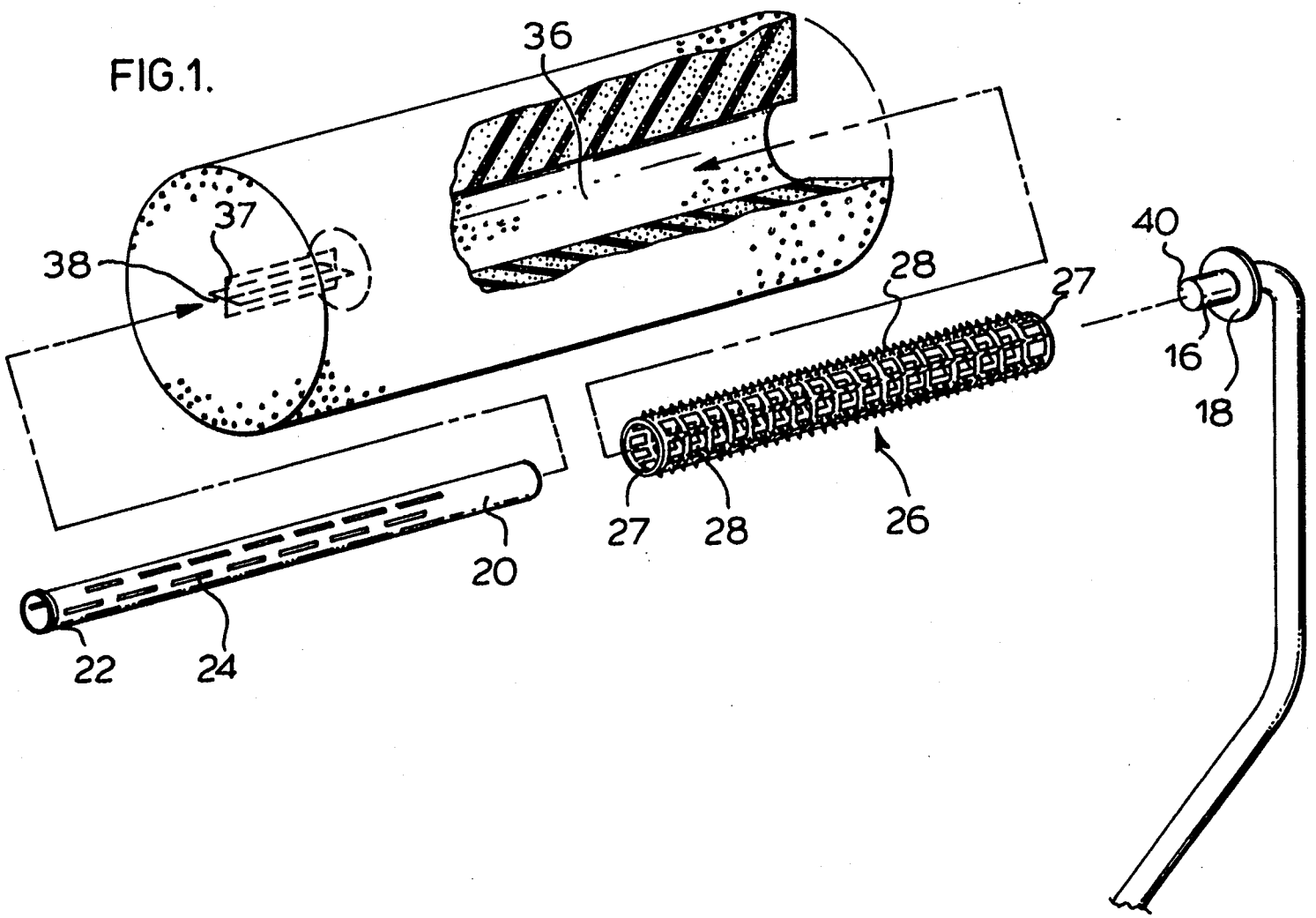
FIG. 1 is an exploded view of a paint roller in accord with the invention.
Figure 2:
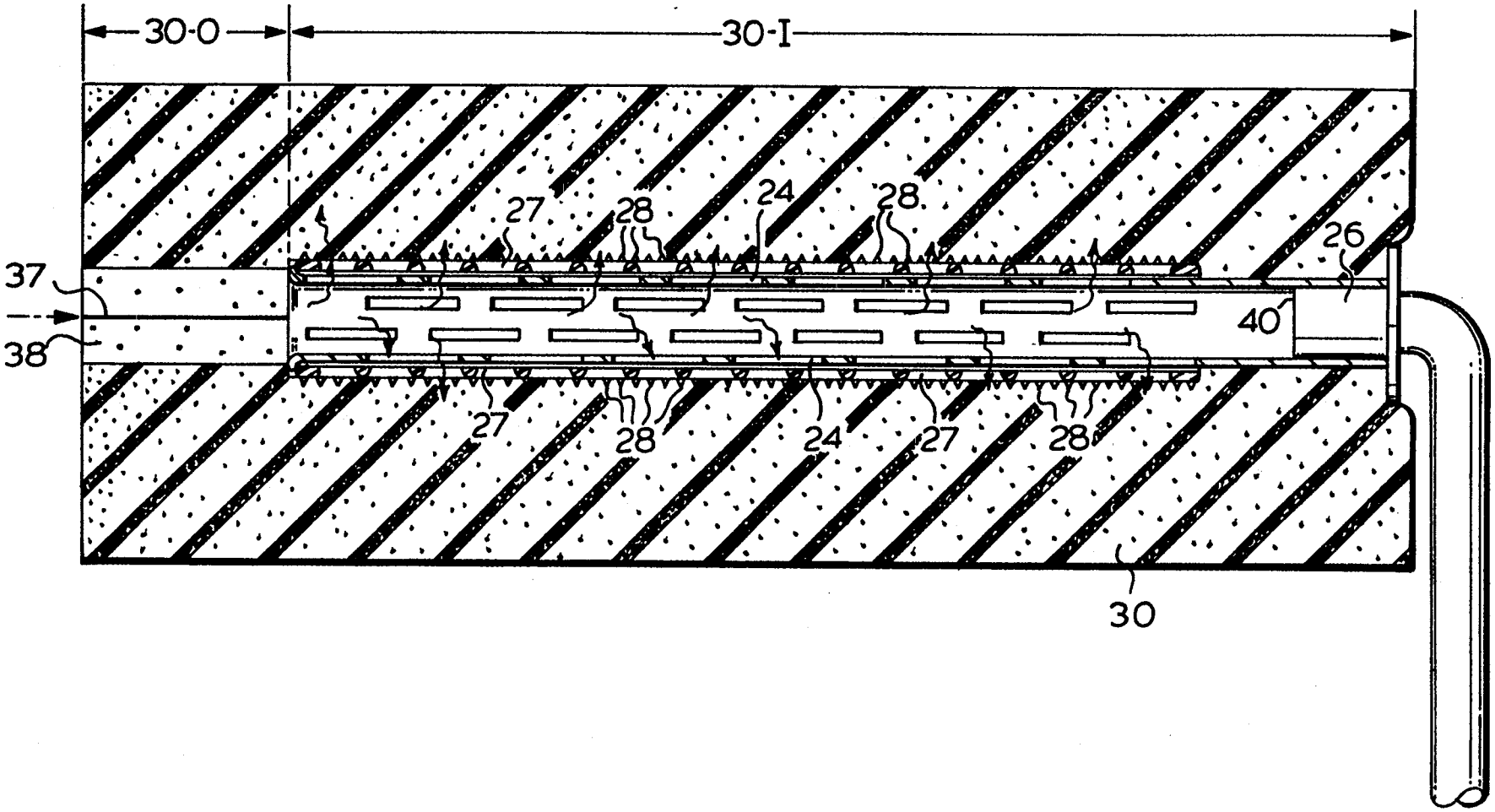
FIG. 2 is a diametral section of the roller assembly.
Figure 3:
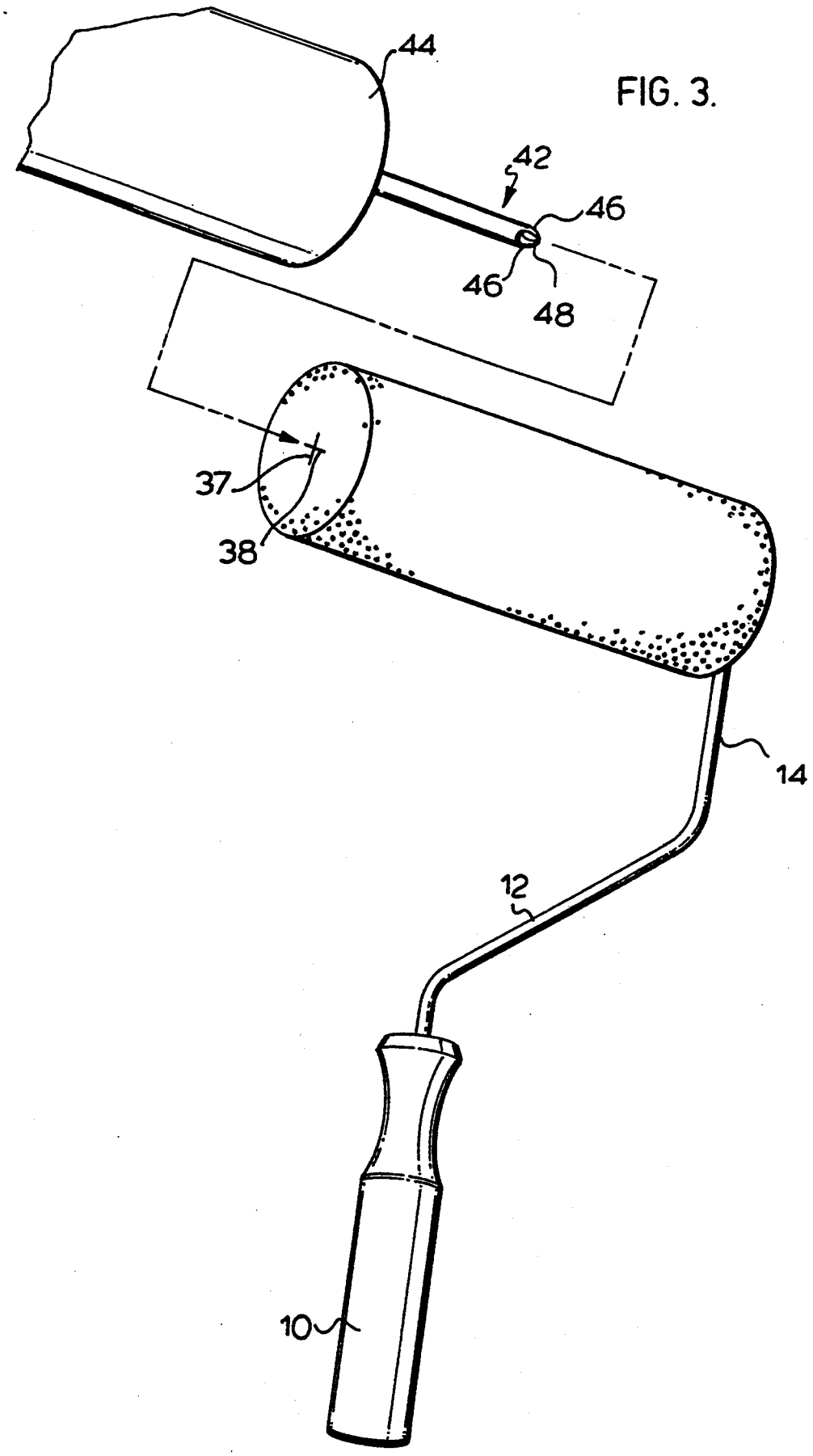
FIG. 3 shows the roller and a paint filler probe.

In the drawings a handle comprises a manual grasping portion 10, an angled portion 12, extent 14, and an axial stub 16 directed approximately transverse to the manual grasping portion 10 and having a flange 18 shortly inward of the stub free end.

A tubular axle 20 is frictionally fitted (or otherwise attached) onto the stub end and has an outwardly directly flange 22 at its free end. The tubular axle has an array of apertures 24 in its side wall, the array extending over the expanse of the side wall outward of the connection to stub 16. A apertured sleeve 26 axially in line, is arranged to slidably rotate on and form a bearing with the axle 20. The sleeve is preferably of plastic and may be similar in general shaping to a common type of hair curler with a regular array of apertures 27 in the sleeve walls. Like such hair curlers the sleeve preferably has small outwardly directed tines 28 which usefully may be used to assist in retaining the foam cylinder 30 on the sleeve. However, it is noted that, due to the dimensioning of bore 32 in the foam cylinder, it will remain on the sleeve, under normal usage, if the tines are omitted.

The cylinder 30 is of open celled resilient foam and must be axially longer than the sleeve to provide an outer extent 30-O. The roller on its inner extent 30-I is provided with an inwardly open bore 36 which is dimensioned to be slightly resiliently enlarged by the sleeve 26 to receive and cling thereto, and an outer extent 30-O which is slit with crossed, resiliently closed slits 37, 38 which extend from bore 36 to the free end of the cylinder and are approximately coaxial therewith.

The roller as so far described has, initially, the axle 20 separate from the stub 16. The apertured sleeve 28, is then threaded into the axle to be retained thereon by the flange 22 at the free end. Instead of a single sleeve 22 a plurality of aligned sleeves may be used. The axle is then attached to the stub. This may be by threading or by any other conventional means but I prefer to provide for the attachment of these members by dimensioning them so that the axle 20 is a forced fit on the stub end. (Since paint will be squeezed into the free end of the axle under pressure a stopper 40 for paint flow is provided in stub 16.

With the axle 20 with its rotatable sleeve 26 mounted on the handle, the free end of the sleeve 26 is then forced into the bore 36 in the foam roller 30. The bore 36 is dimensioned to allow this, given the resiliency of the foam but also dimensioned to cling to the sleeve thereafter, thus retaining the foam cylinder 30 on the sleeve 26, after such forced insertion. Preferably the 'purchase' between the sleeve and the roller is improved by providing small outwardly extending tines 28 on the sleeve which are received in the resilient foam of cylinder 30. If desired the sleeve 26 may be glued inside the foam cylinder before application to the axle. This may be of particular importance if the sleeve and foam cylinder are combined by mass production techniques. In this event it may be possible or convenient to dispense with tines 28.

A hollow probe 42 is provided for the supply of paint to the axle. The probe is shown attached to and to be fed by a squeeze bottle 44 but could equally be attached to a pressure paint pump.

The probe 42 must be designed to, on the one hand, enter and distend the slits 37, 38 in the free end of the foam roller and, at the same time to release paint into the hollow axle. I prefer to use a probe whose open end terminates in diametrically opposed points 46 which are bent into form a pointed tip, while between the points and the body of the probe apertures 40 are defined through which the paint may be released into the axle.

In operation the probe 42 is inserted in the slits 37, 38 of the free end of the foam roller, distending the foam and such insertion is continued until the probe tip is resting in the free end of the axle 20. The bottle is then squeezed and paint flows out of openings 48 and fills the axle 20 and, due to the open cell quality of the foam, will flow through, the foam, to the radially outer surface, and also, with an axial component along the foam end 50 of the foam cylinder.

The probe is then withdrawn. Due to the resiliency of the foam, the slits close and prevent escape of paint through the slits. The slits therefore perform the function of a one way valve, while dispensing with the necessity of a separate such valve.

The roller may then be used. The intermittent pressure of the roller on the surface being painted will cause outward flow of the paint through the cell.

The invention therefore dispenses with the necessity for a separate one-way valve but allows filling from the free end of the roller which is convenient in respect of both use and manufacture.

I claim:

1. Paint roller including:

paint roller including a handle; and a roller assembly extending from a handle end to a free end, said roller assembly comprising:

a tubular axle attached to said handle and extending therefrom to a free end, said axle being open at its free end, said axle being apertured in its side walls to allow the escape of paint outwardly therethrough, a resilient sleeve dimensioned to form a bearing with, and to slidably rotate on said axle, said sleeve being apertured to allow the passage of paint outwardly therethrough, a resilient open celled foam cylinder having an axial inner extent and an axial outer extent, said inner extent including an axial bore dimensioned to receive and resiliently attach said cylinder to said sleeve, said outer extent provided with a normally closed axial slit.

2. Paint roller as claimed in claim 1 in combination with a feed tube, adapted to receive a supply of paint at one end and at the other end adapted to distend the said slit and supply paint into the free end of said axle.

3. Paint roller as claimed in claim 1 wherein said outer extent is less than one half the axial length of said foam cylinder.

4. Paint roller as claimed in claim 2 wherein said outer extent is less than one half the axial length of said foam cylinder.

5. Paint roller as claimed in claim 1 wherein said outer extent is less than one quarter the axial length of said foam cylinder.

6. Paint roller as claimed in claim 5 wherein said outer extent is less than one quarter the axial length of said foam cylinder.

* * * * *